US007655609B2

(12) United States Patent
Torres et al.

(10) Patent No.: US 7,655,609 B2
(45) Date of Patent: Feb. 2, 2010

(54) SOIL RELEASE AGENT

(75) Inventors: Eduardo Torres, Boiling Springs, SC (US); Dominick J. Valenti, Greenville, SC (US); Emily W. Michaels, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 447 days.

(21) Appl. No.: 11/601,233

(22) Filed: Nov. 17, 2006

(65) Prior Publication Data

US 2007/0130695 A1 Jun. 14, 2007

Related U.S. Application Data

(60) Provisional application No. 60/749,386, filed on Dec. 12, 2005, provisional application No. 60/749,390, filed on Dec. 12, 2005, provisional application No. 60/759,942, filed on Jan. 18, 2006.

(51) Int. Cl.
*C11D 1/68* (2006.01)
*C11D 1/72* (2006.01)

(52) U.S. Cl. ..... 510/299; 510/276; 510/278; 510/302; 510/356; 510/367; 510/528

(58) Field of Classification Search ..... 510/228–437, 510/528
See application file for complete search history.

(56) References Cited

U.S. PATENT DOCUMENTS

| | | | | |
|---|---|---|---|---|
| 1,515,647 | A | 11/1924 | Airheart | 117/169 |
| 2,734,834 | A | 2/1956 | Rainard et al. | 117/169 |
| 2,786,787 | A | 3/1957 | Florio | 117/169 |
| 2,788,295 | A | 4/1957 | Cooke et al. | 117/169 |
| 2,810,948 | A | 10/1957 | Cogovan et al. | 28/74 |
| 2,928,754 | A | 3/1960 | Schappel | 106/286 |
| 2,999,774 | A | 9/1961 | Schappel | 117/139.5 |
| 3,206,408 | A | 9/1965 | Vitalis et al. | 252/161 |
| 3,493,424 | A | 2/1970 | Mohrlok et al. | 117/126 |
| 3,639,290 | A | 2/1972 | Fearnley et al. | 252/545 |
| 3,714,064 | A | 1/1973 | Vossos | 252/313 |
| 3,901,992 | A | 8/1975 | Payne et al. | 428/96 |
| 3,940,359 | A | 2/1976 | Chambers | 260/29.6 |
| 3,962,100 | A | 6/1976 | Murphy et al. | 510/333 |
| 4,005,024 | A | 1/1977 | Rodriguez et al. | 252/89 |
| 4,025,444 | A | 5/1977 | Murphy et al. | 510/332 |
| 4,043,965 | A | 8/1977 | Dickson | 260/29.6 |
| 4,075,110 | A | 2/1978 | Duffin | 510/517 |
| 4,116,885 | A | 9/1978 | Derstadt et al. | 252/532 |
| 4,203,851 | A | 5/1980 | Ramachandran | 510/101 |
| 4,210,417 | A | 7/1980 | McClain et al. | 8/137 |
| 4,624,889 | A | 11/1986 | Bries | 428/264 |
| 4,661,267 | A | 4/1987 | Dekker et al. | 510/517 |
| 4,713,193 | A | 12/1987 | Tai | 510/532 |
| 4,744,911 | A | 5/1988 | Baeck et al. | 510/333 |
| 4,785,060 | A | 11/1988 | Nagler | 525/444 |
| 4,834,895 | A | 5/1989 | Cook et al. | 510/528 |
| 4,844,831 | A | 7/1989 | Joubert et al. | 252/140 |
| 4,846,982 | A | 7/1989 | Madore et al. | 252/8.75 |
| 4,937,277 | A | 6/1990 | O'Lenick, Jr. | 524/318 |
| 4,956,447 | A | 9/1990 | Gosselink et al. | 528/272 |
| 5,082,578 | A | 1/1992 | Langer et al. | 510/321 |
| 5,156,906 | A | 10/1992 | Holland | 442/93 |
| 5,364,553 | A | 11/1994 | Cao | 252/174.12 |
| 5,688,758 | A | 11/1997 | Reinehr et al. | 510/516 |
| 5,691,298 | A | 11/1997 | Gosselink et al. | 510/475 |
| 5,888,290 | A | 3/1999 | Engle et al. | 106/287.12 |
| 5,948,744 | A * | 9/1999 | Baillely et al. | 510/299 |
| 6,071,869 | A | 6/2000 | Materniak et al. | 510/280 |
| 6,159,548 | A | 12/2000 | Moody | 427/389.9 |
| 6,165,545 | A | 12/2000 | Moody | 427/140 |
| 6,191,101 | B1 | 2/2001 | Jacques et al. | 510/515 |
| 6,398,911 | B1 | 6/2002 | Schroeder et al. | 162/164.4 |
| 6,465,416 | B2 | 10/2002 | Verestrat et al. | 510/475 |
| 6,482,789 | B1 * | 11/2002 | Kvietok et al. | 510/357 |
| 6,491,840 | B1 | 12/2002 | Frankenbach et al. | 252/8.91 |
| 6,495,058 | B1 | 12/2002 | Frankenbach et al. | 252/8.91 |
| 6,503,876 | B1 * | 1/2003 | Broeckx | 510/349 |
| 6,579,837 | B1 | 6/2003 | Fleury et al. | 510/299 |
| 6,645,392 | B2 | 11/2003 | Frankenbach et al. | 252/8.91 |
| 6,652,766 | B1 | 11/2003 | Frankenbach et al. | 252/8.91 |
| 6,784,149 | B2 | 8/2004 | Bauer et al. | 510/334 |
| 6,787,510 | B2 | 9/2004 | Santos et al. | 510/101 |
| 6,803,407 | B2 | 10/2004 | Chrobaczek et al. | 524/588 |
| 6,857,225 | B2 | 2/2005 | Petrea et al. | 47/58.1 |
| 6,864,223 | B2 | 3/2005 | Smith et al. | 510/475 |
| 6,878,684 | B2 | 4/2005 | Ellson et al. | 510/522 |
| 6,908,895 | B2 | 6/2005 | Bakker et al. | 510/444 |
| 6,948,276 | B2 | 9/2005 | Petrea et al. | 47/58.1 |

(Continued)

FOREIGN PATENT DOCUMENTS

CA 985113 3/1976

(Continued)

OTHER PUBLICATIONS

Cooke T. F., "Soil Release Finishes for Fibres and Fabrics", Textile Chemist and Colorist, 1087, 19(1) 31-41.

Patent Cooperation Treaty PCT International Search Report. Date of Mailing, Jul. 12, 2007. International Application No. PCT/US2006/046872.

*Primary Examiner*—Lorna M Douyon
*Assistant Examiner*—Tri V Nguyen
(74) *Attorney, Agent, or Firm*—Cheryl J. Brickey

(57) ABSTRACT

The invention relates to a soil release agent comprising a multi-branched soil release/wetting agent having an oxygen-containing polyfunctional base compound and at least two surfactant branches attached thereto, wherein each surfactant branch includes at least one hydrophilic and at least one hydrophobic constituent and a polyester release agent in an aqueous solution.

4 Claims, No Drawings

U.S. PATENT DOCUMENTS

| | | | | |
|---|---|---|---|---|
| 6,949,498 | B2 | 9/2005 | Murphy et al. | 510/327 |
| 2001/0011068 | A1 | 8/2001 | Bird et al. | 510/507 |
| 2002/0123625 | A1 | 9/2002 | Polovsky et al. | 536/120 |
| 2002/0192366 | A1 | 12/2002 | Cramer et al. | 427/180 |
| 2003/0106261 | A1 | 6/2003 | Petrea et al. | 47/58.1 |
| 2003/0144169 | A1 | 7/2003 | Dupont et al. | 510/343 |
| 2003/0192130 | A1 | 10/2003 | Kaaret et al. | 8/115.51 |
| 2004/0110655 | A1 | 6/2004 | Yamashita et al. | 510/421 |
| 2004/0186308 | A1 | 9/2004 | Koch et al. | 556/413 |
| 2004/0250354 | A1 | 12/2004 | Hamers et al. | 8/137 |
| 2004/0261314 | A1 | 12/2004 | Petrea et al. | 47/58.1 |
| 2005/0028442 | A1 | 2/2005 | Petrea et al. | 47/58.1 |
| 2005/0037944 | A1 | 2/2005 | Grandmaire et al. | 71/11 |
| 2005/0193791 | A1 | 9/2005 | Petrea et al. | 71/11 |
| 2006/0135395 | A1 | 6/2006 | Schneiderman et al. | 510/424 |
| 2006/0135396 | A1 | 6/2006 | Schneiderman et al. | 510/424 |
| 2007/0027106 | A1 * | 2/2007 | Zerkowski et al. | 514/54 |

FOREIGN PATENT DOCUMENTS

| | | | |
|---|---|---|---|
| DE | 2714954 | | 10/1978 |
| DE | 140 367 | | 2/1980 |
| DE | 3243983 | | 5/1984 |
| DE | 3641314 | | 6/1988 |
| DE | 3943019 | | 7/1991 |
| DE | 4405930 | | 8/1995 |
| EP | 0300525 | | 1/1989 |
| EP | 398137 | | 11/1990 |
| EP | 241985 | | 1/1991 |
| EP | 456569 | | 11/1991 |
| EP | 1095959 | | 11/1991 |
| EP | 506312 | | 1/1996 |
| EP | 1238050 | | 6/2001 |
| EP | 0914514 | | 2/2004 |
| FR | 2824841 | | 11/2002 |
| GB | 1527126 | | 10/1978 |
| GB | 1549180 | | 7/1979 |
| GB | 2304727 | | 3/1997 |
| GB | 2322137 | | 8/1998 |
| JP | 61097473 | | 5/1986 |
| JP | 01246478 | | 10/1989 |
| WO | WO 9012862 | | 11/1990 |
| WO | WO 91/09927 | | 7/1991 |
| WO | WO 92/17523 | | 10/1992 |
| WO | WO 9217523 | | 10/1992 |
| WO | WO 9305138 | | 2/1993 |
| WO | WO 93/05138 | | 3/1993 |
| WO | WO 97/05221 | | 2/1997 |
| WO | WO 00/71806 | | 11/2000 |
| WO | WO 01/02526 | | 1/2001 |
| WO | WO0102526 | | 1/2001 |
| WO | WO 01/88075 | | 11/2001 |
| WO | WO 01/88080 | | 11/2001 |
| WO | WO 03/020819 | | 3/2003 |
| WO | WO 2004/033611 | | 4/2004 |
| WO | WO2005000944 | * | 1/2005 |
| WO | WO 2005/100533 | | 10/2005 |
| WO | WO 2006/097207 | | 9/2006 |

* cited by examiner

SOIL RELEASE AGENT

CROSS-REFERENCE TO RELATED PATENT APPLICATIONS

This application claims priority to U.S. Provisional Applications 60/749,386, filed on Dec. 12, 2005, 60/749,390, filed on Dec. 12, 2005, and 60/759,942 filed on Jan. 18, 2006, and are hereby incorporated by reference.

FIELD OF THE INVENTION

The present invention generally relates to soil release agent. More particularly, the invention relates to soil release agent applied to fabrics with a fabric conditioner.

BACKGROUND OF THE INVENTION

Soil release agents are key ingredients in cleaning, e.g., textile laundry and hard surface such as carpet-cleaning; and textile treating. Soil release agents are commonly applied during manufacture of clothing or textile fiber. The primary purpose of the soil release agents is to make it easier to clean the textile fibers by home cleaning methods using conventional household machines or cleaners.

For example, in laundering processes normally employed, such as washing in a conventional home washing machine or hand washing with detergent bars, it is usually very difficult to remove soil and/or oily stains from textile material. Moreover, assuming that the undesirable materials are removed from the textile and/or a fairly clean textile material is being washed, soil remaining in the wash water is often redeposited onto the textile material prior to the end of the wash cycle. Hence, when the textile material is removed from the washing machine and subsequently dried, it has not been properly cleaned. Thus, textile material after use rarely assumes a truly clean appearance, but instead tends to gray and/or yellow due to the soil and/or oily materials deposited or redeposited and remaining thereon.

Also, synthetic fibers, and, therefore, fabrics having synthetic fibers incorporated therein or made entirely of synthetic fibers, are hydrophobic and oleophilic. Therefore, the oleophilic characteristics of the fiber permit oil and grime to be readily embedded in the fiber, and the hydrophobic properties of the fiber prevent water from entering the fiber to remove the contaminants from the fiber.

The purpose of a soil-release treatment is to help in the removal of soils during the cleaning of the item. Soil-release agents are typically added during textile manufacturing as a mill treatment. They are mostly applied to 100% polyester fabric via, padding (continuous or semi-continuous), or by exhaustion during dyeing and scouring. Generally, the polymer is fixed onto the fabric surface via a crosslinking agent or heat-setting (sorptive bonding). By design, these treatments are intended to be permanent.

BRIEF SUMMARY OF THE INVENTION

The invention is a soil release agent that increases the cleanability in textiles based on its soil release performance and increases the moisture management of the treated surface.

The present invention provides advantages and/or alternatives over the prior art by providing a soil release agent comprising a multi-branched soil release/wetting agent having an oxygen-containing polyfunctional base compound and at least two surfactant branches attached thereto, wherein each surfactant branch includes at least one hydrophilic and at least one hydrophobic constituent and a polyester release agent in an aqueous solution.

DETAILED DESCRIPTION OF THE INVENTION

The invention adds the benefit of oil and soil release to natural and synthetic (or blends thereof) fibers in fabrics. The invention material is added to the rinse cycle of the laundering process and can be added directly to the fabric conditioner without further modification of the formulation or used without fabric conditioner. The invention material can also be delivered via the dryer using a laundry sheet. Additionally, moisture transport on polyester and on cotton (natural and synthetic fabrics) is significantly enhanced; this is believed to give the consumer a better feeling fabric.

The invention materials impart a soil release characteristic to fabric to which is applied without the use of fluorochemicals. It is desirable to have products without the use of fluorochemicals because of fluorochemicals potential negative impact on the environment.

The soil release agent may be applied in liquid form, pellet form, or granular form. The soil release agent is preferably biodegradable and thus can be considered as a green approach to soil and oil removal.

The multi-branched soil release/wetting agent comprises multi-branched surfactants with both hydrophobic and hydrophilic constituents within each branch which are attached to a polyfunctional base compound. More detailed description of the preferred chemistries and synthesis techniques and processes may be found in US Applications 2005/0193791, 2005/0028442, and 2004/0261314 and U.S. Pat. Nos. 6,948,276 and 6,857,225, all of which are incorporated by reference.

The multi-branched soil release/wetting agent includes at least one multi-branched oxygen-containing polyfunctional compound-based soil release/wetting agent. Such a polyfunctional compound may be a polyol, a polycarboxylic acid, a lactone (the ring structure of which will open upon reaction to provide the necessary reactive sites for surfactant addition thereto), an amino acid, or mixtures thereof, wherein the moieties include reactive end groups for reaction with surfactant-like groups to form the desired branches therein. In such a base compound, the oxygen-containing functionalities (oxygen alone, or as part of a carboxylic acid group) provide the reactive sites and thus act as linking groups between the base compound and the surfactant-like branches. Alternatively, in cases where both oxygen-containing functionalities and nitrogen-containing functionalities are present, such as in amino acids, both functionalities may provide reactive sites which act as linking groups between the base compound and the surfactant-like branches.

The term polyol, for this invention, basically covers any compound with at least three hydroxyl moieties thereon. Likewise, polycarboxylic acid encompasses compounds having at least three such acid moieties present thereon. Lactone is a heterocyclic compound with at least two oxygen groups thereon. Amino acid generally encompasses any of the amino acids having a carboxylic acid and an amino functional group attached to the same tetrahedral carbon atom.

Thus, particular classes of polyols suitable for this purpose include, without limitation, tri-to octa-hydric alcohols such as pentaerythritol, diglycerol,α-methylglucoside, sorbitol, xylitol, mannitol, erythritol, dipentaerythritol, arabitol, glucose, sucrose, maltose, fructose, mannose, saccharose, galactose, leucrose, and other alditol or sugar molecules or polysaccharides; polybutadiene polyols; castor oil-derived polyols;

hydroxyalkyl methacrylate copolymers; hydroxyalkyl acrylate polymers; polyvinyl alcohols; glycerine; 1,1,1-trimethylolpropane; 1,1,1-trimethylolethane; 1,2,6-hexanetriol; butanetriol; and mixtures thereof. Potentially preferred base compounds are the alditol types, particularly sorbitol and sucrose.

Suitable polycarboxylic acids include, without limitation, tartaric acid; citric acid; ascorbic acid; 2-phosphono-1,2,4-butane tricarboxylic acid; glucuronic acid; ethylenediaminetetraacetic acid; gluconic acid; cyclohexane hexacarboxylic acid; mellitic acid; saccharic acid; mucic acid; diethylenetriamine pentaacetic acid; glucoheptonic acid; lactobionic acid; 3,3',4,4'-benzophenone tetracarboxylic acid; amino propyl trimethoxysilane; aminopropyltriethoxysilane; 3-glycidoxypropyltrimethoxy silane; 3-glycidoxypropyltriethoxysilane; 3-(triethoxysilysilyl) propyl isocyanate; 3-(trimethoxysilyl)propyl isocyanate; diaminopropane-N,N,N',N'-tetraacetic acid; aconitic acid; isocitric acid; 1,2,3,4-butanetetracarboxylic acid; nitrilotriacetic acid; tricarballylic acid; N-(phosphonomethyl)iminodiacetic acid; 3-[[tris(hydroxymethyl)methyl]amino]-1-propanesulfonic acid; 2-[[tris(hydroxymethyl)methyl]amino]-1 -ethanesulfonic acid; 3-[bis(2-hydroxyethyl)amino]-2-hydroxy-1-propanesulfonic acid; 3-[N-trishydroxymethylmethylamino]-2-hydroxypropanesulfonic acid; N-tris [hydroxymethyl]methyl4-aminobutanesulfonic acid; 3-aminoadipic acid; 1,3-diamino-2-hydroxypropane-N,N,N',N'-tetraacetic acid; triethylenetetraaminehexaacetic acid; β-carboxyaspartic acid; α-hydroxymethylaspartic acid; tricine; 1,2,3,4-cyclopentanetetracar-boxylic acid; 6-phosphogluconic acid; and mixtures thereof.

Suitable lactones include, without limitation, glucoheptonic lactone and glucooctanoic-gamma-lactone. Suitable amino acids include, without limitation, aspartic acid, α-glutamic acid, and β-glutamic acid.

While it has been disclosed that the inventive additive formulation includes at least one multi-branched oxygen-containing polyfunctional compound-based wetting agent, yet another embodiment of the invention includes the use of at least one multi-branched oxygen-free polyamine compound-based wetting agent. The oxygen-free polyamine compound-based wetting agent contains at least three amine moieties, and it is believed that the amine moieties provide multiple highly reactive nitrogen-containing end groups for reaction with surfactant-like groups to form the desired branches therein. Thus, instead of reactive sites comprising oxygen-containing groups alone, or the combination of oxygen-containing and nitrogen-containing groups, as disclosed above, it is possible that nitrogen-containing groups alone can also be used as reactive sites which act as linking groups between the base compound and the surfactant-like branches. Examples of such oxygen-free polyamine compound-based wetting agents include, without limitation, diethylenetriamine, triethylenetetraamine, tetraethylenepentamine, and mixtures thereof.

The multi-branched soil release/wetting agent may be of any type as broadly described above and that provides the above-discussed water movement through function of the multi-branched structure. Preferably, and without limitation, such an agent may be chosen from the class of compounds that are alditol-based, thus having five or more free oxygen groups for reaction with surfactant-type constituents to form the desired multiple branches thereon. Upon degradation of any or all such resultant oxygen linkages, the free constituents, as noted above, exhibit the necessary surfactant-like soil release/wetting benefits on a continuous basis. The compounds that meet such a description are broad, and, heretofore, have not been utilized for such fabric treatment purposes.

In addition to the multi-branched soil release/wetting agent above, it has been found that by using glycerin, sorbitol and other ethoxylated, propoxylated saccharide or polysaccharide based compounds or ethoxylated, propoxylated water-soluble waxes (ex. PEG) as additives to fabric conditioners in the rinse cycle or the dryer it is possible to increase the soil and oil release and moisture wicking on textiles.

The multi-branched soil release/wetting agent may be used alone in the rinse cycle and/or dryer or with an additional polyester release aid. Unexpectedly, it has been found that using the multi-branched soil release/wetting agent and the polyester release aid in combination, the soil release properties are greater than the two chemicals characteristics separately. Applicants do not wish to be bound by any theory, but it is believed that there is a synergistic effect between the two chemicals to produce the excellent soil release properties. When the multibranched soil release/wetting agent and polyester release aid are used in combination, the multibranched soil release/wetting agent is preferably 20 to 80 percent by weight of the soil release agent and the polyester release aid is preferably 20 to 80 percent by weight of the release agent.

The soil-release activity of ethylene terephthalate/polyethylene oxide terephthalate copolymers called "polyester release aids" in the finishing of textiles, in particular polyester-based textiles, and the use of said copolymers as soil-release agents in detergent formulations for the washing, with or without pretreatment, of textiles, in particular polyester-based textiles, is well known (U.S. Pat. Nos. 4,116,885 and 4,785,060).

These copolymers can, for example, derive from the transesterification/condensation of poly(ethylene terephthalate) and of polyethylene glycol (U.S. Pat. No. 4,785,060).

The preferred polyester release aid composition is a terephthalic polyester composition which can be obtained by transesterification/condensation of a poly(ethylene terephthalate) and of a polyethylene glycol and which in particular exhibits particularly good soil-release properties, described in U.S. Pat. No. 6,579,837 (Fleury et al.), incorporated by reference.

According to the invention, it is a terephthalic polyester composition (TPC) comprising, as a mixture an ethylene terephthalate homooligomer ($PET_1$) essentially comprising oxyethylene terephthalate (TE) repeat units of formula (I)

$$—C(O)\text{-}A\text{-}C(O)—O—CH_2—CH_2—O— \quad (I)$$

where A represents the 1,4-phenylene group, and a block terephthalic copolymer ($PET_2$/TE-POE) comprising at least one polyethylene terephthalate block ($PET_2$) composed of oxyethylene terephthalate (TE) repeat units of formula (I)

$$—C(O)\text{-}A\text{-}C(O)—O—CH_2—CH_2—O— \quad (I)$$

where A represents the 1,4-phenylene group, and at least one polyoxyethylene terephthalate block (TE-POE) of formula $$—C(O)\text{-}A\text{-}C(O)—O—CH_2—CH_2—O—(CH_2—CH_2—O)_n—$$

the value of n being such that said block exhibits a number-average molecular mass of the order of 1500 to 4000, preferably of the order of 3000 to 4000, said composition being characterized in that:

the amount of (TE) units of the polyethylene terephthalate (PET.sub.1) does not represent more than 10%, preferably not more than 7%, of all the (TE) units present in the terephthalic polyester composition (TPC), the amount by weight of all the (TE) units present in said (TPC) composition represents at least 11%, preferably from 11.5 to 17%, of the weight of said (TPC) composition, the amount by weight of mono(oxyethyleneoxy) (OEO) residues of formula $$_{1/2}O—CH_2—CH_2—O_{1/2}$$

represents at least 1.3%, preferably from 1.3 to 2.3%, of the weight of said terephthalic polyester composition (TPC), said (OEO) residues belonging to the oxyethylene aromatic diester (OAD) groups of formula $$-A-C(O)—O—CH_2—CH_2—O—C(O)-A-$$

present in all the ($PET_1$) and ($PET_2$) blocks, and in that the weight-average molar mass of said block terephthalic copolymer ($PET_2$ /TE-POE) is at least 30,000, preferably at least 35,000, very particularly at least 40,000. The ends of the chains of ($PET_1$) homooligomers are generally composed of $$—C(O)-A-C(O)—O—CH_2—CH_2—OH$$

units. The ends of the chains of block terephthalic copolymer ($PET_2$/TE-POE) are generally composed of $$—C(O)-A-C(O)—O—CH_2—CH_2—OH$$

units and/or $$—(CH_2—CH_2—O)_n-1-CH_2—CH_2—OH$$

units.

Another multi-branched soil release/wetting agent having an oxygen-containing polyfunctional base compound and at least two surfactant branches attached thereto, wherein each surfactant branch includes at least one hydrophilic and at least one hydrophobic constituent and silicone linker may be used. This type of long chained, multi-branched silicone compounds are also known as a class of polypodand, which we are using as silane based soil release agents. The general formulation of at least some of the branches is as follows:

$$R—Si—(O—R^1)_x$$

Where

R=alkyl, branched alkyl, aryl, benzyl, alkoxy, aryloxy, or hydrogen $R^1$=surfactant branch which includes both hydrophilic and hydrophobic constituents, wetters disclosed in US Patent Application 2005/0193791 (incorporated by reference), or hydrogen $R^1$ can be a mix of different chains including hydrogen

X=1-3

Preparation of one example of the molecule of this type starts with 1 molar equivalent of Isobutyltrichlorosilane (Aldrich Chemicals) to which 3 molar equivalents of a an EO-PO-Copolymer (MW~2900) (US2003/0106261) is added. The mixture is then heated between 80-110° C. under a nitrogen sweep for ~8 hours and then ready for use. This is only one procedure to produce these compounds, other processes are also possible. Other molecules that fit into this class of materials were synthesized and tested and performed similarly.

This polypodand chemistry may be used alone or with the polyester release aid and may be in liquid, pellet, or grain form. If in liquid form, it is preferably in an aqueous solution or dispersion.

It has long been recognized that certain chemical compounds have the capability of imparting softness to textile fabrics. These compounds, which are known generally as "softening agents", "fabric softeners", or "softeners", have been used both by the textile industry and by home and industrial laundry processors to soften finished fabrics, thereby making them smooth, pliable and fluffy to handle. In addition to the quality of softness, the fabrics have a reduced tendency to static cling and are easier to iron. Fabric conditioner is defined as any substrate that changes the condition of the textile. Some examples of fabric conditioner include, fabric softener, ex. Downy Ultra™ in liquid form or dryer sheets, ex. Downy Sheets™ in solid form.

The soil release agent may be added separately to fabric during the rinse cycle of laundering, or may be added to a fabric conditioner (typically sold as fabric softeners). The soil release agent may also be added separately to a dryer sheet for exhaustion during the drying cycle, or may be added to a fabric conditioner (typically sold as fabric softening dryer sheet)The fabric conditioner used with the soil release agent may be any known fabric conditioning chemistry. The large majority of home laundering agents available on the market today under the name of softeners are compositions based on quaternary ammonium salts containing two long-chain alkyl groups within the molecule, such as di-hydrogenated tallow-alkyl dimethylammonium chloride, for instance. This is because quaternary ammonium salts produce satisfactory softening effects on various fibers even when used in small quantities.

In other fabric conditioning compositions, non-ester-linked quaternary ammonium fabric softening agents have been used although there is a trend away from such compounds to ester-linked quaternary ammonium fabric softening agents. It is desirable to use ester-linked compounds due to their inherent biodegradability. Such ester-linked quaternary ammonium compounds contain hydrocarbyl chains which can be unsaturated, partially hardened or fully saturated.

The combination of a fabric conditioner and the soil release agent during the laundry rinse cycle (via fabric softener etc.) and/or drying (via laundry dryer sheet) enhances the soil release properties and moisture wicking characteristics without adversely affecting the aesthetic value or hand of the textile.

Preferably, the soil release agent is added with a fabric conditioner during a wash cycle or on a dryer sheet with fabric conditioner via the drying cycle. The soil release agent may be the multi-branched soil release/wetting agent singly, the multi-branched soil release/wetting agent with the polyester release aid, the silane based soil release agent singly, or the silane based soil release agent with the polyester release aid. Preferably, the soil release agent is added in an amount between 0.01 to 0.9, more preferably 0.05 to 0.9%, and more preferably 0.03 to 0.7 percent by active weight on fabric. In one embodiment, the soil release agent is added in an amount between 0.1 to 0.7 percent by active weight on the fabric.

The laundry would be loaded into a laundry machine and detergent would be added. The rinse additive is then applied during the rinse cycle of the wash. Various methods such as direct application, through a ball (fabric softener ball that releases its contents during the rinse cycle), or through the machine can be employed. Then the water would be removed from the fabric. This can be accomplished by air drying, machine drying, or ironing the fabric. Preferably, the laundered materials are then dried in a standard consumer tumble dryer. Another method of applying would be during the drying process. During the drying cycle a laundry sheet with the chemicals on it is added to the tumble dryer. The clothes are dried for the appropriate time and the chemicals are exhausted onto the laundered clothing. The treatment is non-durable and can be renewed in successive laundering cycles.

The soil release agent improves the soil and oil stain release and moisture wicking. When ironing is desired, preferred compositions of the present invention also act as an excellent ironing aid. The present invention makes the task of ironing easier and faster thus making it easier to work wrinkles out of the fabric. When used as an ironing aid, the compositions of the present invention help produce a crisp, smooth appearance, but also retaining a quality of softness.

The soil release agent when used without the polyester release aid also has another unexpected benefit. It has been observed that when the multi-branched soil release/wetting agent when used at levels between 0.01-4.0%, more preferably 0.1-4.0%, more preferably between 0.1 and 2.0%, and still more preferably between 0.5% and 2.0% in fabric conditioner, it acts as an emulsion stabilizer. Thus the fabric conditioners (which are typically unstable white cast emulsions) is stabilized by the wetter and does not phase separate even under extreme conditions 40° C. oven for 60 days. This is also observed with other emulsions and is not limited to fabric conditioners. This increase in stability enables potentially valuable formulation flexibility (ex. new ingredients or amounts can now de added). Furthermore, manufacturing, storage, shipping and shelf life could all benefit from a more stable product.

The soil release agent may also be sprayed onto the garment. The term "spray-application" or "spray-applied" is intended to encompass the application of such compositions to target fabrics through the utilization of a spray-trigger mechanism and/or device as is well known in the art. Such a mechanism and/or device provides an effective manner of uniformly dispersing droplets of the composition over a relatively broad surface area of a target substrate. In such a manner, a more controlled approach to applying such a composition is provided since very small amounts of the actual active ingredient is necessary to effectuate the desired dewrinkling, anti-rewrinkling, and soil release properties to the fabric. Thus, atomization, droplet formation and application on an even basis, and other non-limiting and similar spraying techniques are encompassed by such a term.

The method itself may also require a simple rubbing, brushing, flattening of the target fabric surface after spray-application, followed by drying time to permit the water (and other potential carrier) to evaporate from the surface and thus provide a comfortable, dry, dewrinkled fabric (such as a garment, tablecloth, etc.). Pulling taut the treated fabric should also suffice.

The target fabrics may be of any type that exhibits a propensity for wrinkling, including those made from cotton, polyester, polyamide, ramie, wool, linen, and the like, as well as blends made therefrom.

Although water is a required carrier component, other vehicles may be admixed therewith if desired including alcohols and other easily evaporated solvents. However, it is most highly preferred to have a simplified composition of water as the sole carrier component in order to provide an environmentally friendly formulation and to reduce the costs involved in producing such a composition.

In addition, other components may be present as well, including, without limitation, antistatic agents, preservatives, fragrances, perfumes, colorants, chelating agents, wetting agents, surfactants, antimicrobial agents, insecticide agents, other fiber lubricating compounds, cyclodextrines, and the like. Of particular importance are physical property modifiers such as rheology, viscosity, and the like modifiers, in order to permit better spray-application of the liquid composition directly onto a target fabric surface.

Test Methods

Stain Application

Samples were tested according to the Oily Stain Release Method AATCC 130-2000 with the variation that the samples were visually assessed and given a ranking of 1 to 5 (1 being the worst and 5 being the best) with 0.5 increments. A description of the staining and washing methods following AATCC 130-2000 is as follows:

For oily stains, a flat surface was covered with aluminum foil and 2 layers of "Scott" paper towels (one-ply sheets #01482). Next, using small droplet bottles, 5 drops of oil were dropped in the same location, and then covered with wax paper and a 5 lb weight for 1 minute. The samples were then hung to dry. The oil used was Burned Motor Oil (BMO) and Bacon Grease (obtained from Oscar Meyer). More stains in the food, oil, and dirt categories were tested with similar results to those shown in the examples section.

For food stains a flat surface was covered with aluminum foil and 2 layers of "Scott" paper towels (one-ply sheets #01482). Next, a 1.25 inches (approx. 3.2 cm) diameter stain was applied using the back of a regular plastic pipette. The samples were then hung to dry. The foods used were Heinz brand barbeque sauce (BBQ).

For the synthetic dirt stains, a flat surface was covered with aluminum foil and 2 layers of "Scott" paper towels (one-ply sheets #01482). Next, a 1:2, dirt to water mixture was rubbed onto the fabric with a gloved finger to obtain a stain equal to 1.25 inches diameter. The samples were then hung to dry. The dirt used was Synthetic Carpet Soil (#9-22-04).

The fabric size used in each test was between 11 by 7 (27.9 by 17.8 cm) inches to 11 by 13 inches (27.9 by 33.0 cm). The fabrics used were from 100% cotton Hanes t-shirts and 100% polyester (Milliken and Company) that were each pre-washed with Tide™ liquid detergent.

Washing Procedure

All washing was done in a standard consumer washer machine on the large load setting. The machine used 20 -22 gallons water (76 L-83 L), 4 lb fabrics (1.82 Kg fabrics), 128 g Tide™ liquid detergent, and 46 g Downy™ fabric softener. The washing temperature was set at warm, 105° F.±5° F. (40° C.±3° C.) and the rinse temperature was set at cold, 77° F. (20-25° C.). The washing time included approximately 20 minutes of washing and spin cycles and 20 minutes of rinse and spin cycles.

The samples were dried in a standard consumer dryer at the high temperature (cotton high, 180° F. or 82° C.) setting for 40 minutes. All t-shirts (samples) were pre-washed with Tide™ detergent (4 lb large loading) and rinsed with water and no fabric conditioner before using for the examples.

Preparation of the Experimental Laundry Sheet

A Downy™ dryer sheet (Procter and Gamble) was dipped into a slurry of 60% Sorbitol 9000 80PO20EO (Milliken Chemicals)and 38% Repelotex PF 594 (Rhodia) and 2% water.

The dryer sheet was left to dry for 30 minutes and then was used in the dryer as recommended on the packaging. The effective pickup of the dryer sheet ranged from 2-10 grams of the soil release composition. The preferred amount was between 4-6 grams of release chemical. Other wovens, non-wovens and methods for depositing the soil release chemicals onto the laundry sheet could also have been used. For more detail around dryer sheets with additional chemistries, please see U.S. Pat. No. 6,461,386, incorporated by reference.

Water Take-up Test

1) Cut fabric to be tested into 1 inch by 10 inch strips.
2) Mark a line using a textile marker at 1 inch from the bottom.
3) Place 50 mL of deionized water into a clean beaker.
4) Carefully lower the test strip into the water, allow only 1-2 cm to touch the water. Begin the stop watch as soon as the strip touches the water.
5) Measure the amount of time it requires the water to reach the 1 inch mark.
6) Repeat the experiment a minimum of three times then average the scores.

Analysis of Swatch Samples Via Gretag Macbeth Coloreve

Stain intensity was measured using a Gretag Macbeth coloreye loaded with the Pro Pallet software. The instrument was set using D65 illuminant, measuring reflectance.

1) A blank sample (unstained textile, washed and treated) is first read onto the instrument and the data stored as the control.
2) Each stain on the textile samples are then scanned the same way the blank was measured (average of six scans) and then compared to the blank textile. The score that is used is the absolute value of the delta L (measurement of whiteness). The closer to 0 the better the score. The lower numbers indicate better efficiency.

Sample Preparation and Testing for Emulsion Stabilization

All samples were prepared in the same fashion at higher and lower concentrations of additive with the same outcome, for simplicity only the 2% results are shown. Can be used from 0.01%-4%, preferred between 0.03-2.0% for emulsion stabilization.

1. The additive was added at 2% by weight of fabric conditioner (Downy™).
2. The mixture was stirred for 10 minutes to ensure homogeneity.
3. The samples were placed into a 40° C. oven and left there for 60 days.
4. The samples were checked daily at approximately the same hour at which the experiment was started.
5. The number of days for phase separation (emulsion kick out) to occur was
6. recorded.

EXAMPLES

The following chart shows the compositions and manufacturers of the controls and the examples.

TABLE 1

Chemical compositions of examples

| | Composition | Manufacturer |
|---|---|---|
| Control 1 | 100% Downy ™ | Proctor and Gamble |
| Control 2 | Water | |
| Example 2 | 12% Sorbitol 9000 80PO20EO + 88% Downy ™ | Milliken Chemicals |

TABLE 1-continued

Chemical compositions of examples

| | Composition | Manufacturer |
|---|---|---|
| Example 3 | 20% Sorbitol 9000 80PO20EO/Repelotex 594S + 80% Downy ™ | Milliken Chemicals, Rodia Chemicals |
| Example 4 | 8% Repelotex PF594 + 92% Downy ™ | Rhodia Chemicals |
| Example 5 | 12% Isobutylsilyl-(EOPO Copolymer (MW2900))$_3$ + 88% Downy ™ | Milliken Chemicals |
| Example 6 | 20% Isobutylsilyl-(EOPO Copoylmer (MW2900))$_3$/ Repelotex PF594 + 80% Downy ™ | Milliken Chemicals, Rhodia Chemicals |
| Example 7 | 20% Sorbitol 9000 10EO80PO10EO/Repelotex PF594 + 80% Downy ™ | Milliken Chemicals, Rhodia Chemicals |
| Example 8 | 12% 9:1 Sorbitol 9000 80PO20EO:Tridecyl alcohol 8EO + 88% Downy ™ | Milliken Chemicals |
| Example 9 | 20% by weight actives Sorbitol 9000 80PO20EO/ Repelotex PF594 on Downy ™ dryer sheet | Milliken Chemicals Rhodia Chemicals |
| Example 10 | Downy ™ Dryer sheet | Proctor and Gamble |
| Example 11 | 2% Sorbitol 9000 80PO20EO + 98% Downy ™ | Milliken Chemicals |
| Example 12 | 2% Sorbitol 9000 10EO80PO10EO + 98% Downy ™ | Milliken Chemicals |
| Example 13 | 2% 9:1 Sorbitol 9000 80PO20EO:Tridecyl alcohol 8EO + 98% Downy ™ | Milliken Chemicals |

The mixture of wetter and polyester release aid was 60% Sorbitol EOPO+40% polyester release aid. Other lower and higher levels can be used with the same efficacy. Other wetter and polyester soil release chemicals at varying concentrations, conditions have been tested and have also been shown to be effective.

TABLE 2

Representative examples for new soil release composition on cotton Stain Release Results

| Example | Burned Motor Oil Score | Dirt Score |
|---|---|---|
| Control 1 | 5.91 | 2.65 |
| Example 2 | 3.53 | 1.62 |
| Example 3 | 3.94 | 1.43 |
| Example 4 | 7.67 | 2.05 |

The lower numbers in Table 2 indicate better efficiency in stain removal as described in Oily Stain Release Method AATCC 130-2000. The data demonstrates that the soil release agents are surprisingly good at removing stains from 100% cotton, the polyester release agent has no positive or negative effect on cotton. The polyester release aid has shown stain release in polyester samples.

TABLE 3

Representative examples for soil release on polyester, comparison of new soil release composition against known polyester release aid

| Example | Burned Motor Oil Score | Dirt Score |
|---|---|---|
| Control 1 | 7.97 | 4.01 |
| Example 3 | 0.63 | 0.69 |
| Example 7 | 0.54 | 0.83 |
| Example 4 | 5.92 | 1.13 |
| Example 8 | 7.62 | 1.20 |

The data from Table 3 demonstrates that the new soil release compositions are good at removing stains from 100% polyester and unexpectedly better than just the polyester soil release agent alone. The addition of the wetters actually enhances the polyester soil release agent activity.

TABLE 4

Silane based composition stain release results

| Example | Burned Motor Oil Score | Dirt Score |
|---|---|---|
| Example 5 | 2.90 on Cotton | 1.20 on Cotton |
| Example 5 | 5.64 on Polyester | 1.19 on Polyester |
| Example 6 | 3.62 on Polyester | 0.63 on Polyester |
| Example 4 | 5.92 on Polyester | 1.13 on Polyester |
| Example 4 | 7.67 on Cotton | 2.05 on Cotton |

The new silane based soil release agents show excellent soil removal properties on cotton and on polyester, both alone and when mixed with the polyester release agent.

TABLE 5

Representative oil and food stains on 100% polyester

| Example | Bacon Grease | BMO | BBQ | Dirt |
|---|---|---|---|---|
| Control 1 | 1.75 | 8.43 | 1.31 | 1.85 |
| Example 3 | 0.42 | 6.97 | 0.43 | 1.26 |
| Example 7 | 0.65 | 3.20 | 0.62 | 1.51 |

TABLE 6

Representative oil and food stains on 100% Cotton

| Example | Bacon Grease | BMO | BBQ | Dirt |
|---|---|---|---|---|
| Control 1 | 0.29 | 8.41 | 0.42 | 1.69 |
| Example 3 | 0.067 | 3.12 | 0.29 | 1.18 |
| Example 7 | 0.083 | 3.27 | 0.38 | 0.92 |

As can be seen in Tables 5 and 6, soil release compositions of the invention are better than the control at removing food and dirt stains on both cotton and polyester fabrics.

TABLE 7

Water take-up test results

| Example | Time (Seconds) |
|---|---|
| Control 2 | 12 |
| Control 1 | 8.7 |
| Example 2 | 7.8 |
| Example 3 | 5.7 |
| Example 4 | 15 |

Water take-up test (polyester breathability) shows that the new compositions enhance water transport on polyester. This means that the fabric will wick away moisture from the wearer to make the garment comfortable for the wearer. As can be seen the repelotex material does not enhance the moisture management of the textile, but is assisted when used in combination with a wetter.

TABLE 8

Soil release properties of new composition delivered in the dryer via laundry sheet

| | BMO | Dirt | Mustard |
|---|---|---|---|
| Example 9 cotton | 4.60 | 0.414 | 0.496 |
| Example 10 cotton | 8.91 | 2.67 | 1.61 |
| Example 9 polyester | 4.31 | 0.401 | 0.342 |
| Example 10 polyester | 7.97 | 4.01 | 0.514 |

The new soil release agents show excellent soil removal properties on cotton and on polyester when added via the dryer on a laundry sheet. Although the results are not as high as the rinse cycle addition they are surprisingly higher than the control fabric. This lower result can be due impart to the non-homogenous distribution of the soil release agent in the dryer.

TABLE 9

Representative examples for wetters as emulsion stabilizers

| Example | Emulsion Stability (Days stable at 40° C.) |
|---|---|
| Control 1 | 5 (phase separation) |
| Example 11 | >60 |
| Example 12 | >60 |
| Example 13 | >60 |

The soil release agent when used without the polyester release aid shows excellent emulsion stabilization properties when added to the fabric conditioner. The stability of the emulsion with the additive is much higher then that of the control (>12 times more stable). Other fabric conditioners were also tested and the results were the same. This holds true to other emulsions and is not limited to fabric conditioners.

The next set of examples (Control Example 2 and Invention Examples 14-22) show the effect of chemistries on soil release. The chemical compositions and concentrations of each example are found in Table 10. Approximately 4 grams of each formulated sample were sprayed onto the sample fabric stains.

TABLE 10

Spray Type of Example and Comparisons

| | Chemistry | Manufacturer |
|---|---|---|
| Control 2 | Water | |
| Invention 14 | 3% Lauryl alcohol 50EO in water | Ethox Chemicals LLC |
| Invention 15 | 3% MonoStearate-40EO in water | Ethox Chemicals LLC |
| Invention 16 | 3% EOPO Copoylmer (MW2900) in water | Milliken Chemicals |
| Invention 17 | 3% MFF-199 in water | Lambent Technologies |
| Invention 18 | 3% bis-stereate capped alkoxylated hydrogentated Castor Oil in water | Milliken Chemicals |
| Invention 19 | 3% E-3482 in water | Ethox Chemicals LLC |
| Invention 20 | 3% Sorbitol 9000 80PO20EO in water | Milliken Chemicals |
| Invention 21 | 3% Millitex PD 75 in water | Milliken Chemicals |
| Invention 22 | 3% Lubril QCX in water | Resolution Specialty Materials |

TABLE 11

Food and Dirt Stain Release Evaluation

| | Burned Motor Oil | Mustard | Red Clay | Foundation | Food/BMO/ Clay Total | BMO/Clay/ Found Total | All Stain Total |
|---|---|---|---|---|---|---|---|
| Control 2 | 1.5 | 1.5 | 3 | 2.5 | 6 | 7 | 8.5 |
| Invention 14 | 2.5 | 1.5 | 5 | 2.5 | 9 | 10 | 11.5 |
| Invention 15 | 2 | 1.5 | 4 | | 7.5 | | |
| Invention 16 | 1.5 | 1.5 | 5 | | 8 | | |
| Invention 17 | 3 | 1.5 | 3.5 | 4 | 8 | 10.5 | 12 |
| Invention 18 | 2 | 1.5 | 4.5 | | 8 | | |
| Invention 19 | 3 | 1.5 | 5 | 3 | 9 | 11 | 12.5 |
| Invention 20 | 2 | | 3.5 | 2.5 | | 8 | |
| Invention 21 | 2.5 | | 5 | 5 | | 12.5 | |
| Invention 22 | 2 | | 4 | 3.5 | | 9 | |

The results from the above (using AATCC method 130-2000) chart show that textiles treated with the spray-on soil release agents are effectively cleaned better or stained less after laundering when a stain is applied to the fabric. The higher the score the better the stain is released.

TABLE 12

Example for demonstrating enhanced ease of ironing, the lower the number the less force is required.

| | Fabic | Coefficient of Friction |
|---|---|---|
| Control 2 | Cotton | 0.305 |
| Invention 14 | Cotton | 0.082 |
| Invention 15 | Cotton | 0.041 |
| Invention 17 | Cotton | 0.115 |
| Invention 19 | Cotton | 0.099 |
| Control 2 | Polyester | 0.169 |
| Invention 14 | Polyester | 0.013 |
| Invention 15 | Polyester | 0.043 |
| Invention 17 | Polyester | 0.034 |
| Invention 19 | Polyester | 0.046 |

The sprayed on materials significantly decrease the coefficient of friction of the treated textile. This translates to less force is required to move an object over the surface, thus in the case of ironing the iron flows over the surface easier.

These examples illustrate the practice of this invention and are not intended to be exhaustive of all possible variations of the invention. The invention has been described in detail with particular reference to certain preferred embodiments thereof, but it will be understood that variations and modifications can be effected within the spirit and scope of the invention.

What is claimed:

1. A soil release agent in an aqueous solution or dispersion comprising a multi-branched soil release/wetting agent comprising:

a polyol compound of tri-to octa-hydric alcohol selected from the group consisting of sorbitol, xylitol, mannitol, pentaertythritol sucrose, saccharose, galactose, leucrose, fructose, mannose, and glucose and at least five surfactant branches attached thereto, wherein each surfactant branch includes at least one hydrophilic and at least one hydrophobic constituent, and wherein each surface branch comprises alkylene oxide moieties selected from the group consisting of ethylene oxide, propylene oxide, butylenes oxide, and mixtures thereof; and, a polyester release aid.

2. The soil release agent of claim 1, wherein the polyester release aid comprises a transesterification/condensation product of a poly(ethylene terephthalate) and a polyethylene glycol.

3. The soil release agent of claim 1, wherein the soil release agent further comprises a fabric conditioner.

4. The soil release agent of claim 1, wherein the soil release agent comprises between 10 and 90 percent by weight the multi-branched soil release/wetting agent and between 10 and 90 percent by weight the polyester release aid.

* * * * *

UNITED STATES PATENT AND TRADEMARK OFFICE

CERTIFICATE OF CORRECTION

PATENT NO. : 7,655,609 B2
APPLICATION NO. : 11/601233
DATED : February 2, 2010
INVENTOR(S) : Torres et al.

It is certified that error appears in the above-identified patent and that said Letters Patent is hereby corrected as shown below:

In column 14, line 36, after the word "release", delete the word "aid" and replace with the word "agent".

Signed and Sealed this

Thirteenth Day of April, 2010

David J. Kappos

David J. Kappos
*Director of the United States Patent and Trademark Office*